US008224660B2

(12) United States Patent
Philippe et al.

(10) Patent No.: US 8,224,660 B2
(45) Date of Patent: Jul. 17, 2012

(54) METHOD OF CODING A SOURCE AUDIO SIGNAL, CORRESPONDING CODING DEVICE, DECODING METHOD AND DEVICE, SIGNAL, COMPUTER PROGRAM PRODUCTS

(75) Inventors: Pierrick Philippe, Melesse (FR); Christophe Veaux, Paris (FR); Patrice Collen, Montgermont (FR)

(73) Assignee: France Telecom, Paris (FR)

( * ) Notice: Subject to any disclaimer, the term of this patent is extended or adjusted under 35 U.S.C. 154(b) by 950 days.

(21) Appl. No.: 12/282,731

(22) PCT Filed: Mar. 12, 2007

(86) PCT No.: PCT/FR2007/050915

§ 371 (c)(1),
(2), (4) Date: Sep. 12, 2008

(87) PCT Pub. No.: WO2007/104889

PCT Pub. Date: Sep. 20, 2007

(65) Prior Publication Data

US 2009/0083043 A1 Mar. 26, 2009

(30) Foreign Application Priority Data

Mar. 13, 2006 (FR) ..... 06 02179

(51) Int. Cl.
*G10L 19/00* (2006.01)

(52) U.S. Cl. ..... 704/500; 704/200; 704/200.1; 704/501

(58) Field of Classification Search ..... 704/200.1, 704/500–503
See application file for complete search history.

(56) References Cited

U.S. PATENT DOCUMENTS

| | | | | |
|---|---|---|---|---|
| 5,627,938 | A * | 5/1997 | Johnston | 704/200.1 |
| 5,657,420 | A | 8/1997 | Jacobs et al. | |
| 5,781,586 | A * | 7/1998 | Tsutsui | 375/241 |
| 6,094,636 | A * | 7/2000 | Kim | 704/500 |
| 6,115,689 | A * | 9/2000 | Malvar | 704/503 |
| 6,349,284 | B1 * | 2/2002 | Park et al. | 704/500 |
| 6,499,010 | B1 * | 12/2002 | Faller | 704/229 |
| 7,523,039 | B2 * | 4/2009 | Manu | 704/501 |
| 7,668,715 | B1 * | 2/2010 | Chaugule et al. | 704/230 |
| 2005/0015259 | A1 | 1/2005 | Thumpudi et al. | |
| 2006/0074693 | A1 * | 4/2006 | Yamashita | 704/500 |
| 2007/0208557 | A1 * | 9/2007 | Li et al. | 704/200.1 |
| 2007/0265836 | A1 * | 11/2007 | Funakoshi | 704/200.1 |

OTHER PUBLICATIONS

Brandenburg et al. "MPEG-4 natural audio coding", Signal Processing: Image Communication 15, pp. 423-444, 2000.*
International Preliminary Report on Patentability and Written Opinion of Counterpart Application No. PCT/FR2007/050915 Filed on Mar. 12, 2007.*

(Continued)

*Primary Examiner* — Jialong He
(74) *Attorney, Agent, or Firm* — David D. Brush; Westman, Champlin & Kelly, P.A.

(57) ABSTRACT

A method is provided for coding a source audio signal. The method includes the following steps: coding a quantization profile of coefficients representative of at least one transform of the source audio signal, according to at least to distinct coding techniques, delivering at least two sets of data representative of a quantization profile; selecting one of the sets of data representative of a quantization profile, as a function of a predetermined selection criterion; transmitting and/or storing the set of data representative of a selected quantization profile and an indicator representative of the corresponding coding technique.

19 Claims, 3 Drawing Sheets

OTHER PUBLICATIONS

Christophe Veaux and Pierrick Philippe.: "Scalable Audio Coding with Iterative Auditory Masking", Audio Engineering Society, Convention Paper 6750, Presented at the 120th Convention, Paris, France May 20-23, 2006.

Jin Li: "Embedded Audio Coding (EAC) With Implicit Auditory Masking", Microsoft Research, Dec. 1, 2002.

French Search Report of Counterpart Foreign Application No. FR 0602179 Filed on Mar. 13, 2006.

Jayant, Johnson and Safranek: "Signal Compression Based on Method of Human Perception", Proc. of IEEE, vol. 81, No. 10, pp. 1385-1422, Oct. 1993.

B. Den Brinker, E. and W. Schuijers Oomen: "Parametric Coding for High Quality Audio", in Proc. 112th AES Convention, Munich, Germany, 2002.

M. Schroeder and B. Atal: "Code-Excited Linear Prediction (CELP): High Quality Speech at Very Low Bit Rates", in Proc. IEEE Int. Conf. Acoust, Speech Signal Processing, Tampa, pp. 937-940, 1985.

B. Grill, "A Bit Rate Scalable Perceptual Coder for MPEG-4 Audio", Proc. 103rd AES Convention, New York, Oct. 1997, Preprint 4620.

M. Bosi, K. Brandenburg, S. Quackenbush, L. Fielder, K. Akagiri, H. Fuchs, M. Fuch, M. Dietz, J Herre, G. Davidson, and Y. Oikawa: "MPEG-2 Advanced Audio Coding", AES Journal, vol. 45, No. 10, Oct. 1997.

* cited by examiner

METHOD OF CODING A SOURCE AUDIO SIGNAL, CORRESPONDING CODING DEVICE, DECODING METHOD AND DEVICE, SIGNAL, COMPUTER PROGRAM PRODUCTS

CROSS-REFERENCE TO RELATED APPLICATIONS

This Application is a Section 371 National Stage Application of International Application No. PCT/FR2007/050915, filed Mar. 12, 2007 and published as WO 2007/104889 on Sep. 20, 2007, not in English.

STATEMENT REGARDING FEDERALLY SPONSORED RESEARCH OR DEVELOPMENT

None.

THE NAMES OF PARTIES TO A JOINT RESEARCH AGREEMENT

None.

FIELD OF THE DISCLOSURE

The field of the disclosure is that of the encoding and decoding of audio-digital signals such as music or digitized speech signals.

More particularly, the disclosure relates to the quantization of the spectral coefficients of audio signals, in implementing perceptual encoding.

The disclosure can be applied especially but not exclusively to systems for the hierarchical encoding of audio-digital data, using a scalable data encoding/decoding type system, proposed in the context of the MPEG Audio (ISO/IEC 14496-3) standard.

More generally, the disclosure can be applied in the field of the efficient quantization of sounds and music, for their storage, compression and transmission through transmission channels, for example wireless or wired channels.

BACKGROUND OF THE DISCLOSURE

1. Perceptual Encoding with Transmission of a Masking Curve 1.1 Audio Compression and Quantization Audio compression is often based on certain auditory capacities of the human ear. The encoding and quantization of an audio signal often takes account of this characteristic. The term used in this case is "perceptual encoding" or encoding according to a psycho-acoustic model of the human ear.

The human ear is incapable of separating two components of a signal emitted at proximate frequencies as well as in a limited time slot. This property is known as auditory masking. Furthermore, the ear has an auditory or hearing threshold, in peaceful surroundings, below which no sound emitted will be perceived. The level of this threshold varies according to the frequency of the sound wave.

In the compression and/or transmission of audio-digital signals, it is sought to determine a number of quantization bits to quantize the spectral components that form the signal, without introducing excessive quantization noise and thus impairing the quality of the encoded signal. The goal generally is to reduce the number of quantization bits so as to obtain efficient compression of the signal. What has to be done therefore is to find a compromise between sound quality and the level of compression of the signal.

In the classic prior art techniques, the principles of quantization thus use a masking threshold induced by the human ear and the masking property to determine the maximum amount of quantization noise acceptable for injection into the signal without its being perceived by the ear when the audio signal is rendered, i.e. without introducing any excessive distortion.

1.2 Perceptual Audio Transform Encoding

For an exhaustive description of audio transform encoding, cf. Jayant, Johnson and Safranek, "Signal Compression Based on Method of Human Perception," Proc. Of IEEE, Vol. 81, No. 10, pp. 1385-1422, October 1993.

This technique makes use of the frequency masking model of the ear illustrated in FIG. 1, which presents an example of a representation of the frequency of an audio signal and the masking threshold for the ear. The x-axis 10 represents the frequencies f in Hz and the y-axis 11 represents the sound intensity I in dB. The ear breaks down the spectrum of a signal x(t) into critical bands 120, 121, 122, 123 in the frequency domain on the Bark scale. The critical band 120 indexed n of the signal x(t) having energy $E_n$ then generates a mask 13 within the band indexed n and in the neighboring critical bands 122 and 123. The associated masking threshold 13 is proportional to the energy $E_n$ of the "masking" component 120 and is decreasing for the critical bands with indices below and above n.

The components 122 and 123 are masked in the example of FIG. 1. Furthermore, the component 121 too is masked since it is situated below the absolute threshold of hearing 14. A total masking curve is then obtained, by combination of the absolute threshold of hearing 14 and of masking thresholds associated with each of the components of the audio signal x(t) analyzed in critical bands. This masking curve represents the spectral density of maximum quantization noise that can be superimposed on the signal, when it is encoded, without its being perceptible to the human ear. A quantization interval profile, also loosely called an injected noise profile, is then put into shape during the quantization of the spectral coefficients coming from the frequency transform of the source audio signal.

FIG. 2 is a flow chart illustrating the principle of a classic perceptual encoder. A temporal source audio signal x(t) is transformed in the frequency domain by a time-frequency transform bloc 20. A spectrum of the source signal, formed by spectral coefficients $X_n$ is then obtained. It is analyzed by a psycho-acoustic model 21 which has the role of determining the total masking curve C of the signal as a function of the absolute threshold of hearing as well as the masking thresholds of each spectral component of the signal. The masking curve obtained can be used to know the quantity of quantization noise that can be injected and therefore to determine the number of bits to be used to quantify the spectral coefficients or samples. This step for determining the number of bits is performed by a binary allocation block 22 which delivers a quantization interval profile $\Delta_n$ for each coefficient $X_n$. The binary allocation bloc seeks to attain the target bit rate by adjusting the quantization intervals with the shaping constraint given by the masking curve C. The quantization intervals $\Delta_n$ are encoded in the form of scale factors F especially by this binary allocation block 22 and are then transmitted as ancillary information in the bit stream T.

A quantization block 23 receives the spectral coefficients $X_n$ as well as the determined quantization intervals $\Delta_n$, and then delivers quantized coefficients $\hat{X}_n$.

Finally, an encoding and bit stream forming block 24 centralizes the quantized spectral coefficients $\hat{X}_n$ and the scale factors F, and then encodes them and thus forms a bit stream containing the payload data on the encoded source audio signal as well as the data representative of the scale factors.

2. Hierarchical Building of the Masking Curves

A description is provided here below of the drawbacks of the prior art in the context of hierarchical encoding of audio-digital data. However, an embodiment of the invention can be applied to all types of encoders of audio-digital signals, implementing a quantization based on the psycho-acoustic model of the ear. These encoders are not necessarily hierarchical.

Hierarchical coding entails the cascading of several stages of encoders. The first stage generates the encoded version at the lowest bit rate to which the following stages provide successive improvements for gradually increasing bit rates. In the particular case of the encoding of audio signals, the stages of improvement are classically based on perceptual transform encoding as described in the above section.

However, one drawback of perceptual transform encoding in a hierarchical approach of this kind lies in the fact that the scale factors obtained have to be transmitted from the very first level or basic level. They then represent a major part of the bit rate allocated to the low bit rate level, as compared with the payload data.

To overcome this drawback and therefore save on the transmission of the injected quantization noise profile, i.e. the scale factors, a masking technique known as an "implicit" technique has been proposed by J. Li in "Embedded Audio Coding (EAC) With Implicit Auditory Masking", ACM Multimedia 2002. A technique of this kind relies on the hierarchical structure of the encoding/decoding system for the recursive estimation of the masking curve at each refinement level, in exploiting an approximation of this curve, with refinement from level to level.

The updating of the masking curve is thus reiterated at each hierarchical level, using coefficients of the transform quantized at the previous level.

Since the estimation of the masking curve is based on the quantized values of the coefficients of the time-frequency transform, it can be done identically at the encoder and decoder: this has the advantage of preventing the transmission of the profile of the quantization interval, or quantization noise, to the decoder.

3. Drawbacks of the Prior Art

Even if the implicit masking technique, based on hierarchical encoding, prevents the transmission of the masking curve and thus provides for a gain in bit rate relative to the classic perceptual encoding in which the profile of the quantization interval is transmitted: the inventors have noted that it nevertheless has several drawbacks.

Indeed, the masking model implemented simultaneously in the encoder and the decoder is necessarily closed-ended, and can therefore not be adapted with precision to the nature of the signal. For example a single masking factor is used, independently of the tonal or atonal character of the components of the spectrum to be encoded.

Furthermore, the masking curves are computed on the assumption that the signal is a standing signal, and cannot be properly applied to the transient portions and to sonic attacks.

Furthermore, since the masking curves are obtained at each level from coefficients or residues of coefficients quantized at the previous levels, the masking curve for the first level is incomplete because certain portions of the spectrum have not yet been encoded. This incomplete curve does not necessarily represent an optimum shape of the profile of the quantization interval for the hierarchical level considered.

SUMMARY

An embodiment of the invention relates to a method for encoding a source audio signal comprising the following steps:

- encoding a quantization interval profile of coefficients representative of at least one transform of the source audio signal, according to at least two distinct encoding techniques, delivering at least two sets of data representative of the quantization interval profile;
- selecting one of the sets of data representative of the quantization interval profile according to a selection criterion based on measurements of distortion of signals rebuilt respectively from said sets of data and on the bit rate needed to encode said sets of data;
- transmitting and/or storing the set of data representative of the selected quantization interval profile and an indicator representative of the corresponding encoding technique.

An embodiment of the invention thus relies on a novel and inventive approach to the encoding of the coefficients of a source audio signal enabling the reduction of the bit rate allocated to the transmission of the quantization intervals while at the same time keeping an injected quantization noise profile that is as close as possible to the one given by a masking curve computed from full knowledge of the signal.

An embodiment of the invention proposes a selection between different possible modes of computation of the quantization interval profile. It can thus make a selection between several templates of quantization interval profiles or injected noise profiles. This choice is reported by an indicator, for example, a signal contained in the bit stream formed by the encoder and transmitted to the audio signal rendering system, namely the decoder.

The selection criterion can take account especially of the efficiency of each quantization interval profile and the bit rate needed to encode the corresponding set of data.

Thus, a compromise is obtained between the bit rate needed to convey the data representative of the signal and the distortion affecting the signal.

The quantization is therefore optimized. At the same time the bit rate needed to transmit data representative of the profile of the quantization interval, providing no direct information on the audio signal itself, is minimized.

In other words, at the coder, the choice of a quantization mode is done by comparison of a reference masking curve, estimated from the audio signal to be encoded, with the noise profiles associated with each of the modes of quantization.

The technique of an embodiment of the invention results in improved efficiency of compression as compared with the prior art techniques, and therefore greater perceived quality.

For at least a first of the encoding techniques, the set of data may correspond to a parametric representation of the quantization interval profile.

In other words, among the techniques proposed to quantify the coefficients of a transformed audio signal, there is the possibility of representing the quantization interval profile parametrically.

In one particular embodiment, the parametric representation is formed by at least one straight-line segment characterized by a slope and its original value.

A second encoding technique may deliver a constant quantization interval profile.

This encoding mode therefore proposes the encoding of the quantization interval profile on the basis of a signal-to-noise ratio (SNR) and not on a masking curve of the signal.

According to a third advantageous encoding technique, the quantization interval profile corresponds to an absolute threshold of hearing.

In other words, the set of data representative of the quantization interval profile may be empty and no data on the quantization interval profile is transmitted from the encoder to the decoder. The absolute threshold of hearing is known to the decoder.

According to a fourth encoding technique, the set of data representative of the quantization interval profile may include all the quantization intervals implemented.

This fourth encoding technique corresponds to the case in which the quantization interval profile is determined as a function of the masking curve of the signal, known solely to the encoder, and entirely transmitted to the decoder. The bit rate required is high but the quality of rendering of the signal is optimal.

In one particular embodiment, the encoding implements a hierarchical processing that delivers at least two levels of hierarchical encoding, including one basic level and at least one refinement level comprising information on refinement relative to the basic level or to a preceding refinement level.

In this case, it is provided in a fifth encoding technique that the set of data representative of the quantization interval profile will be obtained at a given refinement level in taking account of data built at the preceding hierarchical level.

An embodiment of the invention can thus be applied efficiently to hierarchical encoding and proposes the encoding of the quantization interval profile according to a technique in which this profile is refined at each hierarchical level.

The selection step may be implemented at each hierarchical encoding level.

Should the encoding method deliver frames of coefficients, the selection step may be implemented for each of the frames.

The signaling can thus be done not only for each processing frame but, in the particular application of a hierarchical encoding of data, for each refinement level.

In other cases, the encoding may be implemented on groups of frames having predefined or variable sizes. It can also be provided that the current profile will remain unchanged so long as a new indicator has not been transmitted.

An embodiment of the invention furthermore pertains to a device for encoding a source audio signal comprising means for implementing such a method.

An embodiment of the invention also relates to a computer program product for implementing the encoding method as described here above.

An embodiment of the invention also relates to an encoded signal representative of a source audio signal comprising data representative of a quantization interval profile. Such a signal comprises especially:

- an indicator representative of a technique for encoding an implemented quantization interval profile chosen, when encoding, from among at least two available techniques, as a function of a selection criterion based on measurements of distortion of signals rebuilt respectively from the quantization interval profile encoded according to said techniques and on the bit rate necessary to encode the quantization interval profile according to said techniques;
- a set of data representative of the corresponding quantization interval profile.

Such a signal may comprise especially data on at least two hierarchical levels obtained by a hierarchical processing, comprising a basic level and at least one refinement level comprising refinement information relative to the basic level or to a preceding refinement level, and includes an indicator representative of an encoding technique for each of the levels.

When the signal of an embodiment of the invention is organized in frames of successive coefficients, it may include an indicator representative of the encoding technique used for each of the frames.

An embodiment of the invention also pertains to a method for decoding such a signal. This method comprises especially the following steps:

- extraction from the encoded signal of:
  - an indicator representative of a technique for encoding an implemented quantization interval profile chosen, when encoding, from among at least two available techniques, as a function of a selection criterion based on measurements of distortion of signals rebuilt respectively from the quantization interval profile encoded according to said techniques and on the bit rate necessary to encode the quantization interval profile according to said techniques;
  - a set of data representative of the quantization interval profile;
- rebuilding of the quantization interval profile, as a function of the set of data and of the encoding technique designated by said indicator.

A decoding method of this kind also comprises a step for building a rebuilt audio signal, representative of the source audio signal, in taking into account of the rebuilt quantization interval profile.

For at least a first of the encoding techniques, the set of data may correspond to a parametric representation of the quantization interval profile, and the rebuilding step delivers a quantization interval profile rebuilt in the form of at least one straight-line segment.

For at least a second of the encoding techniques, the set of data may be empty and the rebuilding step delivers a constant quantization interval profile.

For at least a third of the encoding techniques, the set of data may be empty and the quantization interval profile corresponds to an absolute threshold of hearing.

For at least a fourth of the encoding techniques, the set of data may include all the quantization intervals implemented during the encoding method described here above, and the building step delivers a quantization value in the form of a set of quantization intervals implemented during the encoding method.

In one particular embodiment, the decoding method may implement a hierarchical processing that delivers at least two levels of hierarchical encoding, including one basic level and at least one refinement level comprising information on refinement relative to the basic level or to a preceding refinement level.

For at least a fifth of the encoding techniques, the rebuilding step delivers a quantization interval profile obtained, at a given refinement level, in taking account of data built at the preceding hierarchical level.

An embodiment of the invention furthermore pertains to a device for decoding an encoded signal representative of a source audio signal, comprising means for implementing the decoding method described here above.

An embodiment of the invention also relates to a computer program product for implementing the decoding method as described here above

BRIEF DESCRIPTION OF THE DRAWINGS

Other characteristics and advantages shall appear from the following description of a particular embodiment, given by way of an illustrative and non-exhaustive example, and from the appended drawings of which.

DETAILED DESCRIPTION OF ILLUSTRATIVE EMBODIMENTS

1. Structure of the Encoder

Figure 1:
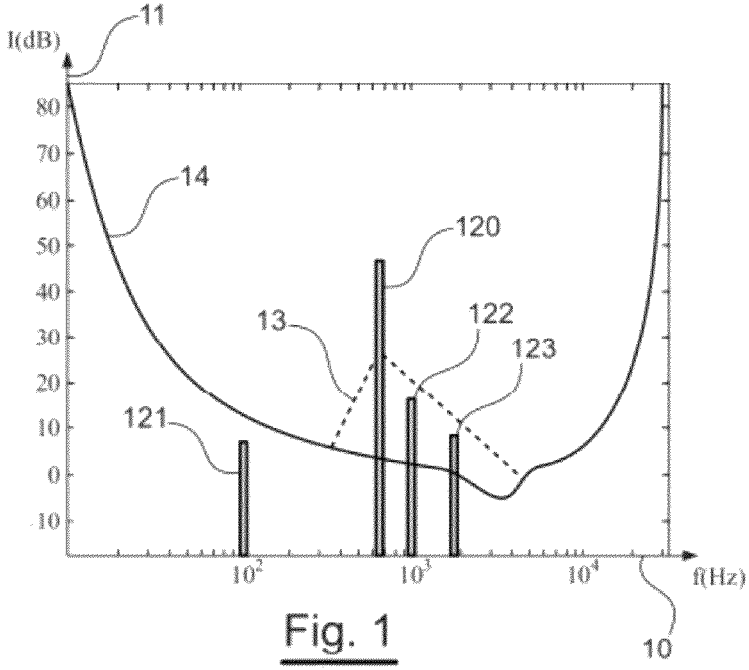
Fig. 1 (PRIOR ART)
FIG. 1 illustrates the frequency masking threshold.
Figure 2:
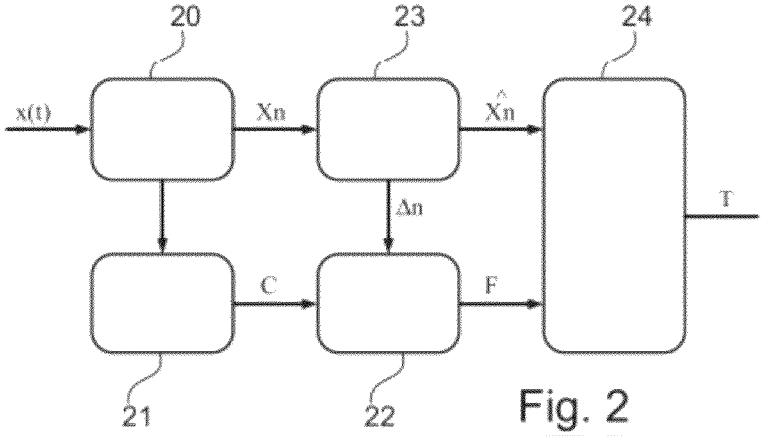
Fig. 2 (PRIOR ART)
FIG. 2 is a simplified flowchart of the perceptual transform encoding according to the prior art.

Here below, a description is provided of an embodiment of the invention in the particular application of hierarchical encoding. It may be recalled that, in this scheme, the hierarchical encoding sets up a cascading of the perceptual quantization intervals at output of a time-frequency transform (for example a modified discrete cosine transform or MDCT) of the source audio signal to be encoded.

An encoder according to this embodiment of the invention is described with reference to FIG. 4. A source audio signal x(t) is to be transformed in the frequency domain, directly or indirectly. Indeed, optionally, the signal x(t) may first of all be encoded in an encoding step 40. A step of this kind is implemented by a "core" encoder. In this case, this first encoding step corresponds to a first hierarchical encoding level, i.e. the basic level. A "core" encoder of this kind can implement an encoding step 401 and a local decoding step 402. It then delivers a first bit stream 46 representative of data of the encoded audio signal at the lowest refinement level. Different encoding techniques may be envisaged to obtain the low bit rate level, for example parametric encoding schemes such as the sinusoidal encoding described in B. den Brinker, E. and W. Schuijers Oomen, "Parametric coding for high quality audio", in Proc. 112th AES Convention, Munich, Germany, 2002" of CELP (Code-Excited Linear Prediction) type analysis-synthesis encoding described in M. Schroeder and B. Atal, "Code-excited linear prediction (CELP): high quality speech at very low bit rates", in Proc. IEEE Int. Conf. Acoust, Speech Signal Processing, Tampa, pp. 937-940, 1985.

A subtraction 403 is done between the samples decoded by the local decoder 402 and the real values of x(t) so as to obtain a residue signal r(t) in the time domain. It is then this residue signal output from the low-bit-rate encoder 40 (or <<core>> encoder) that is transformed from the time space into the frequency space at the step 41. Spectral coefficients $R_k^{(1)}$, in the frequency domain are obtained. These coefficients represent residues delivered by the <<core>> encoder 40, for each critical band indexed k and for the first hierarchical level.

The next encoding level stage 42 contains a step 421 for encoding the residues $R_k^{(1)}$, associated with an implementation 422 of a psycho-acoustic model responsible for determining a first masking curve for the first refinement level. Quantized coefficients of residues $\hat{R}_k^{(1)}$ are then obtained at output of the encoding step 421 and are subtracted (423) from the original coefficients $R_k^{(1)}$ coming from the core encoding step 40. New coefficients $R_k^{(2)}$ are obtained and are themselves quantized and encoded at the encoding step 431 of the next level 43. Here too, a psycho-acoustic model 432 is implemented and updates the masking threshold as a function of the coefficients $\hat{R}_k^{(1)}$ of residues previously quantized.

In short, the basic encoding step 40 ("core" encoder) enables the transmission and decoding, in a terminal, of a low-bit-rate version of the audio signals. The successive stages 42, 43 for quantization of the residues in the transformed domain constitute improvement layers enabling the building of a hierarchical bit stream from the low bit-rate level to the maximum bit-rate desired.

Figure 4:
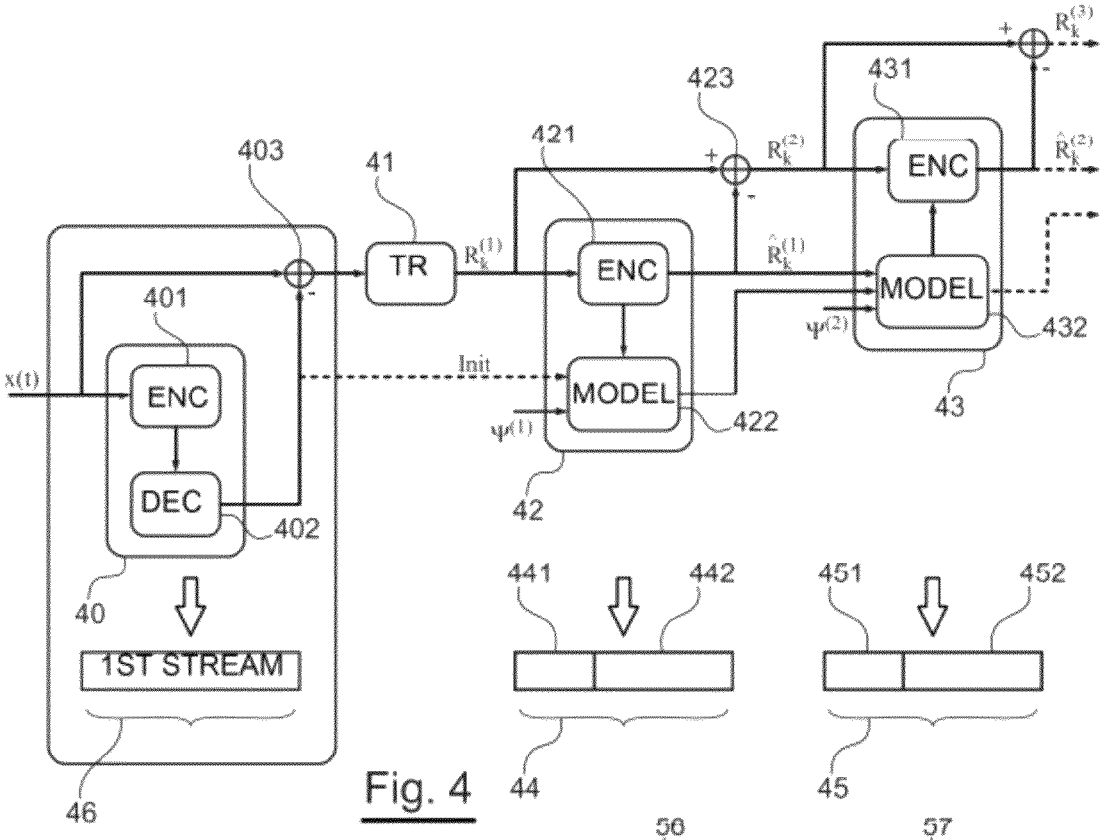
FIG. 4 is a simplified flowchart of the encoding method according to an embodiment of the invention.

According to an embodiment of the invention, as illustrated in FIG. 4, an indicator $\psi^{(1)}$, $\psi^{(2)}$ is associated with the psycho-acoustic model 422, 432 of each encoding level for each of the stages of quantization. The value of this indicator is specific to each stage and controls the mode of computation of the profile of the quantization interval. It is placed as a header 441 and 451 for the frames of quantized spectral coefficients 442, 452 in the associated bitstreams 44,45 formed at each improved encoding level 42,43.

Figure 3:
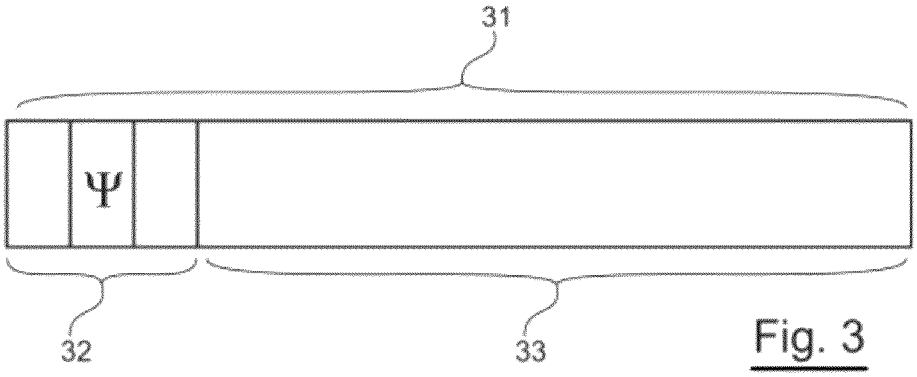
FIG. 3 illustrates an example of a signal according to an embodiment of the invention.

An example of structure of a signal obtained according to this encoding technique is illustrated in FIG. 3. The signal is organized in blocks or frames of data 31 each comprising a header 32 and a data field 33. A block corresponds for example to the data (contained in the field 33) of a hierarchical level for a predetermined time slot. The header 32 may include several pieces of information on signaling, decoding assistance etc. It comprises at least, according to an embodiment of the invention, the information ψ.

2. Structure of the Decoder

Figure 5:
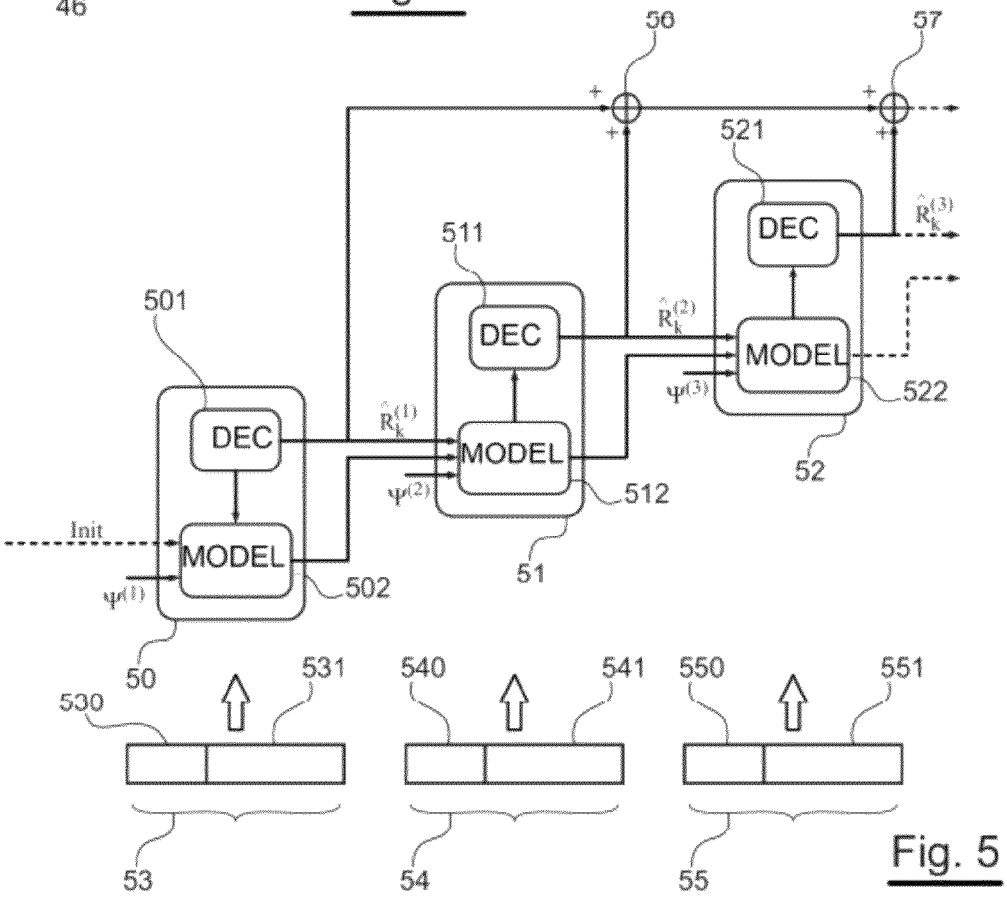
FIG. 5 is a simplified flowchart of the decoding method according to an embodiment of the invention.

Referring to FIG. 5, a description is provided of the decoding method implemented according to an embodiment of the invention, in the case of a hierarchical decoding of the signal of FIG. 3.

In a manner similar to that of the encoding method presented with reference to FIG. 4, the decoding comprises several decoding refinement levels 50, 51, 52.

A first decoding step 501 receives a bit stream 53 containing the data 530 representative of the indicator $\psi^{(1)}$ of the first level, determined during the first encoding step and transmitted to the decoder. The bit stream furthermore contains data 531 representative of spectral coefficients of the audio signal.

According to the quantized coefficients, or the quantized coefficient residues, and the value of $\psi^{(1)}$ received, a psycho-acoustic model is implemented in a first step 502, to determine a first estimation of the masking curve, and thus a quantization interval profile which is used to process the residues of the spectral coefficients available to the decoder at this stage of the decoding method.

The residues of spectral coefficients obtained $\hat{R}_k^{(1)}$ for each critical band indexed k enable an updating of the psycho-acoustic model at the next level of 51, in a step 512 which then refines the masking curve and hence the profile of the quantization intervals. This refinement therefore takes account of the value of the indicator $\psi^{(2)}$ for the level 2, contained in the header 540 of the bit stream 54 transmitted by the corresponding encoder, the quantized residues at the previous level as well as the quantized data 541 pertaining to the level 2 residues included in the bit stream 54.

The quantized residues $\hat{R}_k^{(2)}$ are obtained at output of the second decoding level 51. They are added (56) to the residues $\hat{R}_k^{(1)}$ of the previous level but are also injected into the next level 52 which, similarly, will refine the precision on the spectral coefficients as well as the profile of the quantization intervals, from a decoding step 51 and the implementation of a psycho-acoustic model in a step 522. This level furthermore receives a bit stream 55 sent by the encoder containing the value of the indicator 55 $\psi^{(3)}$ and the quantized spectrum 551.

The quantized residues $\hat{R}_k^{(3)}$ obtained are added to the residues $\hat{R}_k^{(2)}$, and so on and so forth.

In short, the psycho-acoustic model is updated as and when the coefficients are decoded by successive levels of refinement. The reading of the indicator $\psi$ transmitted by the encoder then enables the rebuilding of the noise profile (or quantization interval profile) by each quantization stage.

A detailed description is given here below of the steps for updating the psycho-acoustic model and the model of quantization of the spectral coefficients, common to the encoding method and to the decoding method according to a particular embodiment. A detailed description shall then be made of the step for determining the value of the indicator $\psi$ performed at the time of the encoding, followed by a description of the step for rebuilding the quantization intervals in the decoder.

3. Updating of the Psycho-Acoustic Model

It may be recalled that a psycho-acoustic model takes account of the subbands into which the ear breaks down an audio signal and thus determines the masking thresholds by using psycho-acoustic information. These thresholds are used to determine the quantization interval of the spectral coefficients.

In an embodiment of the present invention, the step (implemented in the steps 422, 432 of the encoding method and in the steps 502, 512, 522 of the decoding method) for the updating the masking curve by the psycho-acoustic model remains unchanged whatever the value of the indicator $\psi$ on the choice of profile of the quantization interval.

By contrast, it is the way in which this updated masking curve is used by the psycho-acoustic model that is conditioned by the value of the indication $\psi$ to determine the profile of the quantization interval implemented to quantify the spectral coefficients (or the residual coefficients determined at a previous refinement level).

At each quantization level (in the particular application of a hierarchical encoding-decoding system) indexed l, the psycho-acoustic model uses the estimated spectrum $\hat{X}_k^{(l)}$ of an audio signal x(t), where k represents the frequency index of the time-frequency transform. This spectrum is initialized at the first quantization refinement level, by the data available at output of the encoding step implemented by the core encoder. At the following quantization levels, the spectrum $\hat{X}_k^{(l)}$ is updated on the basis of the residual coefficients $\hat{R}_k^{(l-1)}$ quantized at output of the previous refinements level according to the following formula: $\hat{X}_k^{(l)}=\hat{X}_k^{(l-1)}+\hat{R}_k^{(l-1)}$, with k=0, . . . , N−1, where N is the size of the transform in the frequency domain.

By convolution of the spectrum $\hat{X}_k^{(l)}$ with the masking pattern obtained by the psycho-acoustic model, it is possible to rebuild a masking threshold associated with the signal x(t).

The masking curve $\hat{M}_k^{(l)}$ estimated at the quantization step indexed l is then obtained as the maximum between the masking threshold associated with the signal x(t) and the curve of absolute hearing.

Furthermore, the encoding and decoding steps each include a step of initialization Init of the psycho-acoustic model during its first implementation (step 422 of the encoding method and step 502 of the decoding method) on the basis of the data transmitted by the core encoder.

Several scenarios can be envisaged depending on the type of core encoder implemented, some examples of which are described in the appendix.

4. Quantization of the Spectral Coefficients

Before providing a precise description of a technique for determining the best value of the indicator $\psi$ which conditions the choice of the quantization interval profile, a detailed description is given in the first place of the way in which an embodiment of the invention computes the number of bits to be allocated to quantify each spectral coefficient of the audio signal, i.e. once the profile of the quantization interval is known.

4.1 Binary Allocation

The description here is situated in the general case of a law of quantization Q, which may correspond for example to a value rounded to the nearest integer. The quantized values $\hat{R}_k^{(l)}$ of the residual coefficients $R_k^{(l)}$ input to the quantization stage indexed l are obtained from the quantization interval profile denoted $\Delta_n^{(l)}$ according to the following equations $$rq_k^{(l)} = Q\left(g_l \frac{R_k^{(l)}}{\Delta_n^{(l)}}\right) \text{ for } kOffset(n) \le k \le kOffset(n+1) \text{ et}$$

$$\hat{R}_k^{(l)} = \frac{\Delta_n^{(l)}}{g_l} Q^{-1}\left(rq_k^{(l)}\right) \text{ for } kOffset(n) \le k \le kOffset(n+1)$$

where $rq_k^{(l)}$ are coefficients with integer values and kOffset(n) designates the initial frequency index of the critical band indexed n.

The coefficient $g_l$ for its part corresponds to a constant gain enabling adjustment of the level of the quantization noise injected in parallel with the profile given by $\Delta_n^{(l)}$.

In a first approach, this gain $g_l$ is determined by an allocation loop in order to attain a target bit rate assigned to each quantization level indexed l. It is then transmitted to the decoder in the bit stream at output of the quantization stage.

In a second approach, the gain $g_l$ is a function solely of the refinement level indexed l and this function is known to the decoder.

4.2 Quantization Interval Profiles

The encoding and decoding methods of an embodiment of the invention then propose the determining of a quantization interval profile $\Delta_n^{(l)}$ on the basis of a choice between several encoding techniques or modes of computation of this profile. The selection is indicated by the value of the indicator $\psi$, transmitted in the bit stream. Depending on the value of this indicator, the profile of the quantization interval is either totally transmitted or partially transmitted or not transmitted at all. In this case, the profile of the quantization interval is estimated in the decoder.

The quantization interval profile $\Delta_n^{(l)}$ used by the quantization interval indexed l is computed from the masking curve available at this stage and from the indicator $\psi^{(l)}$ at input.

In one particular embodiment, the indicator $\psi^{(l)}$ is encoded on 3 bits, to indicate five different techniques of encoding the profile of the quantization interval.

For a value of the indicator $\psi^{(l)}=0$, the masking curve estimated by the psycho-acoustic model is not used and the profile of the quantization intervals is uniform according to the formula $\Delta_n^{(l)}$=cte. The quantization is said to be done in the sense of the signal-to-noise ratio (SNR).

For a value of the indicator $\psi^{(l)}=1$, the quantization interval profile is defined solely on the basis of the absolute threshold of hearing according to the equation $$\Delta_n^{(l)} = \sum_{k=kOffset(n)}^{kOffset(n+1)-1} Q_k,$$

where $Q_k$ designates the absolute threshold of hearing.

In this instance, the encoder transmits no information whatsoever to the decoder on the quantization interval.

For a value of the indicator $\psi^{(l)}=2$, it is the masking curve $\hat{M}_k^{(l)}$ estimated by the psycho-acoustic model at the stage indexed l that is used to define the profile of the quantization intervals according to the equation $$\Delta_n^{(l)} = \sum_{k=kOffset(n)}^{kOffset(n+1)-1} \hat{M}_k^{(l)}.$$

It can be noted that this mode is possible only in the particular application in which a hierarchical building of the masking curve is implemented in the audio signal encoding-decoding system.

For a value of the indicator $\psi^{(l)}=3$, the profile of the quantization interval is then defined from a curve prototype that is parametrizable and known to the decoder. According to a particular, non-exclusive application, this prototype is an affine straight-line, in dB for each critical band indexed n, having a slope $\alpha$. We write $D_n(\alpha)$ with: $\log_2(D_n(\alpha))=\alpha n+K$, where K is a constant.

The value of the slope $\alpha$ is chosen by correlation with the reference masking curve, computed at the encoder from of a spectral analysis of the signal to be encoded. Its quantized value $\hat{\alpha}$ is then transmitted to the decoder and used to define the profile of the quantization intervals according to the formula: $\Delta_n^{(l)}=D_n(\hat{\alpha})$.

Finally, for a value of the indicator $\psi^{(l)}=4$, the profile of the quantization intervals $\Delta_n^{(l)}$ determined at the encoding step is entirely transmitted to the decoder. The pitch values are for example defined from the reference masking curve $M_k$ computed in the encoder from the source audio signal to be encoded. We then have:

$$\Delta_n^{(l)} = \sum_{k=kOffset(n)}^{kOffset(n+1)-1} M_k.$$

5. Determining the Value of the Indicator $\psi$

An embodiment of the invention proposes a particular technique for making a judicious choice of the value of the indicator and hence the quantization interval profile to be applied to encode and decode an audio signal. This choice is made at the encoding step for each quantization level (in the case of a hierarchical encoding) indexed l.

Indeed it is known that, at a given quantization stage, the optimum quantization interval profile with respect to the distortion perceived between the signal to be encoded and the rebuild signal is obtained from the computation of the reference masking curve, based on the psycho-acoustic model and given by the formula:

$$\Delta_n^{(l)} = \sum_{k=kOffset(n)}^{kOffset(n+1)-1} M_k^{(l)}.$$

The choice of a value of the indicator $\psi$ consists in finding the most efficient compromise between the optimality of the quantization interval profile relative to the perceived distortion and the minimizing of the bit rate allocated to the transmission of the profile of the quantization intervals.

A cost function is introduced to obtain a compromise of this kind:

$$C(\psi)=d(\Delta_n^{(l)}(\psi),\Delta_n^{(l)}(\psi=4))+\theta(\psi) \text{ with } \psi=0,1,2,3,4.$$

This function is used to take account of the efficiency of each of the techniques of encoding the profile of the quantization interval.

The first term $d(\Delta_n^{(l)}(\psi),\Delta_n^{(l)}(\psi=4))$ is a measurement of distance between the quantization interval profile associated with each of the values of the indicator $\psi(\psi=0,1,2,3,4)$ considered and the optimum profile (associated with the value of the indicator $\psi=4$, corresponding to the transmission of the reference masking curve). This distance can be measured as the excess cost, in bits, associated with the use of a "sub-optimal" masking profile. This cost function is computed according to the formula:

$$d(\Delta_n^{(l)}(\psi), \Delta_n^{(l)}(\psi=4)) = \sum_n \left|\log_2(\Delta_n^{(l)}(\psi)) - \log_2(\Delta_n^{(l)}(\psi=4)) - \log_2\left(\frac{G_1}{G_2}\right)\right|$$

with:

$$G_1 = \sum_n \Delta_n^{(l)}(\psi) \text{ and } G_2 = \sum_n \Delta_n^{(l)}(\psi=4).$$

The ratio of the gains $G_1$ and $G_2$ can be used to standardize the quantization interval profiles relative to one another.

The second term $\theta(\psi)$ represents the excess cost in bits associated with the transmission of the profile $\Delta_n^{(l)}(\psi)$ of the quantization intervals. In other words, it represents the number of additional bits (apart from those encoding the indicator $\psi$) that must be transmitted to the decoder to enable the rebuilding of the quantization intervals. That is:

- $\theta(\psi)$ is zero for $\psi=0,1,2$ (corresponding respectively to the techniques of encoding of constant quantization, absolute threshold of hearing and masking curve re-estimated during the decoding step);
- $\theta(\psi)$ represents the number of bids encoding $\hat{\alpha}$ when $\psi=3$ (corresponding to the technique of parametric encoding of the profile of the quantization interval);
- $\theta(\psi)$ is the number of bits encoding the quantization interval $\Delta n^{(l)}$ defined on the basis of the reference curve, when $\psi=4$ (corresponding to the full transmission of the quantization intervals from the encoder to the decoder).

6. Rebuilding of the Quantization Intervals During the Decoding Method

The rebuilding of the profile of the quantization intervals at a quantization stage indexed l is done as a function of the data transmitted by the decoder.

First of all, whatever the technique chosen for encoding the quantization interval, i.e. the value of the indicator $\psi^{(l)}$, the decoder decodes the value of this indicator present as a header of the bit stream received for each frame, and then reads the value of the adjustment gain $g_l$. The cases are then distinguished according to the value of the indicator:

- if $\psi^{(l)}=4$, the decoder reads all the quantization intervals $\Delta_n^{(l)}$;
- if $\psi^{(l)}=3$, the parameter $\hat{\alpha}$ is read and the profile of the quantization interval is computed at the decoder according to the previously introduced formula:: $\Delta_n^{(l)}=D_n(\hat{\alpha})$;
- if $\psi^{(l)}=2$, the decoder computes the profile of the quantization interval according to the previously introduced formula $$\Delta_n^{(l)} = \sum_{k=kOffset(n)}^{kOffset(n+1)-1} \hat{M}_k^{(l)}$$

from the masking curve $\hat{M}_k^{(l)}$ rebuilt at this stage indexed l (recursive building);

if $\psi^{(l)}=1$, the decoder computes the profile of the quantization interval according to the previously introduced formula:

$$\Delta_n^{(l)} = \sum_{k=kOffset(n)}^{kOffset(n+1)-1} Q_k$$

based on the absolute threshold of hearing:

if $\psi^{(l)}=0$, the decoder computes the profile of the quantization interval according to the previously introduced formula: $\Delta_n^{(l)}$=cte.

Once the quantization intervals have been computed at the decoding step, and the previously introduced coefficients $rq_k^{(l)}$ transmitted in the bit stream have been decoded (relative to the payload data of the spectrum coefficients or their residual values), the quantized values $\hat{R}_k^{(l)}$ of the residual coefficients at the stage indexed l are obtained according to the formulae introduced in paragraph 5.5.1 of the present description, relative to binary allocation.

7. Implementation Devices

Figure 6A:
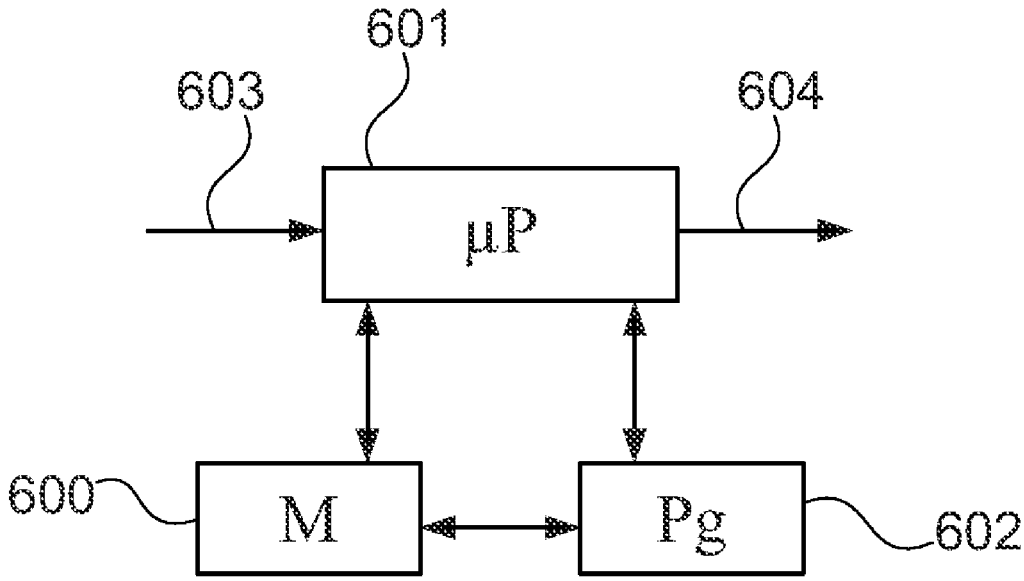
FIGS. 6A and 6B schematically illustrate an encoding device and a decoding device implementing an embodiment of the invention.

The method of an embodiment of the invention can be implemented by an encoding device whose structure is presented with reference to FIG. 6A.

Such a device comprises a memory M 600, a processing unit 601 equipped for example with a microprocessor and driven by the computer program Pg 602. At initialization, the code instructions of the computer program 602 are loaded for example into a RAM and then executed by the processor of the processing unit 601. At input, the processing unit 601 receives a source audio signal to be encoded 603. The microprocessor μP of the processing unit 601 implements the above-described encoding method according to the instructions of the program Pg 602. The processing unit 601 outputs a bit stream 604 comprising a specially quantized data representative of the encoded source audio signals, data representative of a quantization interval profile and data representative of the indicator ψ.

Figure 6B:
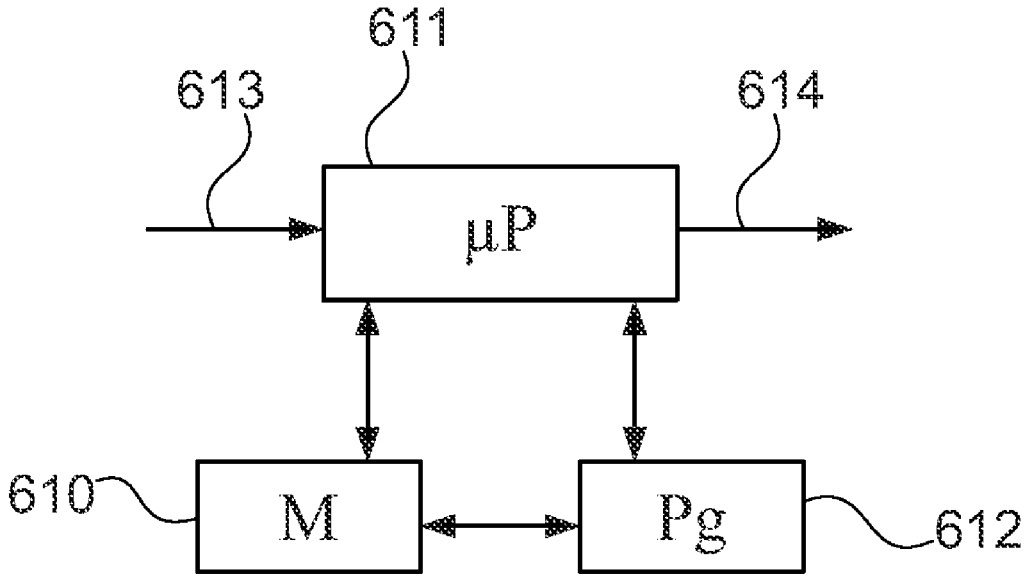

An embodiment of the invention also concerns a device for decoding an encoded signal representative of a source audio signal according to an embodiment of the invention, the simplified general structure of which is illustrated schematically by FIG. 6B. It comprises a memory M 610, a processing unit 611 equipped for example with a microprocessor and driven by the computer program Pg 612. At initialization, the code instructions of the computer program 612 are loaded for example into a RAM and then executed by the processor of the processing unit 611. At input, the processing unit 611 receives bit stream 613 comprising data representative of an encoded source audio signal, data representative of a quantization interval profile and data representative of the indicator ψ. The microprocessor μP of the processing unit 601 implements the decoding method according to the instructions of the program Pg 612 to deliver a rebuilt audio signal 612.

8. Appendix

The psycho-acoustic model can be initialized in several ways, depending on the type of <<core>> encoder implemented at the basic level encoding step.

1 Initialization from the Parameters Transmitted by a Sinusoidal Encoder

A sinusoidal encoder models the audio signal by a sum of sinusoids having variable frequencies and amplitudes that are variable in time. The quantized values of the frequencies and amplitudes are transmitted to the decoder. From these values, it is possible to build the spectrum $\hat{X}_k^{(0)}$ of the sinusoidal components of the signal.

2 Initialization from the Parameters Transmitted by a CELP Encoder

From the LPC (<<linear prediction coding>>) coefficients $a_m$ quantized and transmitted by a CELP (<<Code-excited linear prediction>>) encoder, it is possible to deduce an envelope spectrum according to the following equation:

$$\hat{X}_k^{(0)} = \frac{1}{\left|1 - \sum_{m=1}^{P} a_m \exp\left(-j\frac{2\pi mk}{N}\right)\right|^2}$$

where N is the size of the transform and P is the number of LPC coefficients transmitted by the CELP encoder.

3 Initialization from the Signal Decoded at Output of the Core Encoder

The initial spectrum $\hat{X}_k^{(0)}$ can be estimated simply from a short-term spectral analysis of the signal decoded at output of the core encoder.

A combination of these initialization methods can also be envisaged. For example, the initial spectrum $\hat{X}_k^{(0)}$ can be obtained by addition of the LPC envelope spectrum defined according to the above equation, and from the short-term spectrum estimated from the residue encoded by a CELP encoder.

Although the present disclosure has been described with reference to one or more examples, workers skilled in the art will recognize that changes may be made in form and detail without departing from the scope of the disclosure and/or the appended claims.

The invention claimed is:

1. A method for encoding a source audio signal, wherein the method comprises the following steps:

encoding a quantization interval profile of coefficients representative of at least one transform of said source audio signal, according to at least two distinct encoding techniques, generating at least two sets of data representative of the quantization interval profile;

selecting one of the sets of data as a function of a selection criterion that makes a compromise between: (a) a perceived distortion between said source audio signal to be encoded and signals reconstructed respectively on the basis of said sets of data; and (b) a bit rate necessary to encode said sets of data, said step of selecting being implemented by comparing a reference masking curve, which is estimated on the basis of the audio signal to be encoded, with said sets of data; and transmitting and/or storing said set of data selected by the step of selecting and an indicator representative of the encoding technique corresponding to the selected set of data.

2. The method according to claim 1 wherein, for at least a first of said encoding techniques, said set of data representative of the quantization interval profile corresponds to a parametric representation of said quantization interval profile.

3. The method according to claim 2, wherein said parametric representation is formed by at least one straight-line segment characterized by a slope and a value at its origin.

4. The method according to claim 1, wherein a second of said encoding techniques delivers a constant quantization interval profile.

5. The method according to claim 1 wherein, according to a third encoding technique, said quantization interval profile corresponds to an absolute threshold of hearing.

6. The method according to claim 1 wherein, according to a fourth encoding technique, said set of data representative of the quantization interval profile comprises all quantization intervals implemented.

7. The method according to claim 1 wherein said encoding implements a hierarchical processing that delivers at least two levels of hierarchical encoding, including one basic level and at least one refinement level comprising information on refinement relative to said basic level or to a preceding refinement level.

8. The method according to claim 7 wherein, according to a fifth encoding technique, said set of data representative of the quantization interval profile will be obtained at a given refinement level in taking account of data built at the preceding hierarchical level.

9. The method according to claim 7 wherein the selection step is implemented at each hierarchical encoding level.

10. The method according to claim 1 wherein the method delivers frames of coefficients, and the selection step is implemented for each of the frames.

11. A device for encoding a source audio signal, wherein the device comprises:

means for encoding a quantization interval profile of coefficients representative of at least one transform of said source audio signal, according to at least two distinct encoding techniques, generating at least two sets of data representative of the quantization interval profile;

means for selecting one of the sets of data as a function of a selection criterion that makes a compromise between: (a) a perceived distortion between said source audio signal to be encoded and signals reconstructed respectively on the basis of said sets of data; and (b) a bit rate necessary to encode said sets of data, said step of selecting being implemented by comparing a reference masking curve, which is estimated on the basis of the audio signal to be encoded, with said sets of data; and means for transmitting and/or storing said set of data selected by the step of selecting and an indicator representative of the encoding technique corresponding to the selected set of data.

12. A computer program product stored in a computer-readable memory and comprising program code instructions for the implementation of a method for encoding a source audio signal when executed by a microprocessor, wherein the method comprises:

encoding a quantization interval profile of coefficients representative of at least one transform of said source audio signal, according to at least two distinct encoding techniques, generating at least two sets of data representative of the quantization interval profile;

selecting one of the sets of data as a function of a selection criterion that makes a compromise between: (a) a perceived distortion between said source audio signal to be encoded and signals reconstructed respectively on the basis of said sets of data; and (b) a bit rate necessary to encode said sets of data, said step of selecting being implemented by comparing a reference masking curve, which is estimated on the basis of the audio signal to be encoded, with said sets of data; and transmitting and/or storing said set of data selected by the step of selecting and an indicator representative of the encoding technique corresponding to the selected set of data.

13. A method comprising:

generating an encoded signal representative of a source audio signal, comprising:

data representative of a quantization interval profile;

an indicator representative of a technique for encoding an implemented quantization interval profile chosen, when encoding, from among at least two available techniques, as a function of a selection criterion that makes a compromise between: (a) a perceived distortion between said source audio signal to be encoded and signals reconstructed from the chosen quantization interval; and (b) a bit rate necessary to encode the chosen quantization interval profile according to said techniques selected by comparing a reference masking curve, which is estimated on the basis of the audio signal to be encoded, with said quantization interval profile; and a set of data representative of the chosen quantization interval profile; and transmitting the encoded signal.

14. The method of claim 13, wherein the encoded signal comprises data relative to at least two hierarchical levels obtained by a hierarchical processing, comprising a basic level and at least one refinement level comprising refinement information relative to said basic level or to a preceding refinement level, and an indicator representative of an encoding technique for each of said levels.

15. The method of claim 13, wherein the encoded signal is organized in frames of successive coefficients, and comprises an indicator representative of an encoding technique for each of said frames.

16. A method for decoding an encoded signal representative of a source audio signal, comprising a set of data representative of a quantization interval profile, the method comprising the following steps:

extracting from said encoded signal:

an indicator representative of a chosen technique among at least two available techniques for encoding an implemented quantization interval profile, wherein the chosen technique is chosen, when encoding, as a function of a selection criterion that makes a compromise between: (a) a perceived distortion between said encoded signal and signals reconstructed respectively on the basis of at least two sets of data representative of the quantization interval profile; and (b) a bit rate necessary to encode said at least two sets of data, said quantization interval profile being chosen, when encoding, by comparing a reference masking curve estimated on the basis of the encoded audio signal with said sets of data; and the set of data representative of said quantization interval profile; and rebuilding said quantization interval profile, as a function of said set of data and of the encoding technique designated by said indicator.

17. The method according to claim 16, wherein the method comprises a step of building a rebuilt audio signal, representative of said source audio signal, by taking into account of said rebuilt quantization interval profile.

18. A device for decoding an encoded signal representative of a source audio signal, comprising a set of data representative of a quantization interval profile, the device comprising:

means of for extracting from said encoded signal:

an indicator representative of a chosen technique among at least two available techniques for encoding an implemented quantization interval profile, wherein the chosen technique is chosen, when encoding, as a function of a selection criterion that makes a compromise between: (a) a perceived distortion between said encoded signal and signals reconstructed respectively on the basis of at least two sets of data representative of the quantization interval profile; and (b) a bit rate necessary to encode said at least two sets of data, said quantization interval profile being chosen, when encoding, by comparing a reference masking curve estimated on the basis of the encoded audio signal with said sets of data;

the set of data representative of said quantization interval profile; and means for rebuilding said quantization interval profile, as a function of the set of data and of the encoding technique designated by said indicator.

19. A computer program product stored in a computer-readable memory and comprising program code instructions for implementation of a method for decoding an encoded signal representative of a source audio signal, comprising a set of data representative of a quantization interval profile, when executed by a microprocessor, the method comprising:

extracting from said encoded signal:

an indicator representative of a chosen technique among at least two available techniques for encoding an implemented quantization interval profile, wherein the chosen technique is chosen, when encoding, as a function of a selection criterion that makes a compromise between: (a) a perceived distortion between said encoded signal and signals reconstructed respectively on the basis of at least two sets of data representative of the quantization interval profile; and (b) a bit rate necessary to encode said at least two sets of data, said quantization interval profile being chosen, when encoding, by comparing a reference masking curve estimated on the basis of the encoded audio signal with said sets of data; and the set of data representative of said quantization interval profile; and rebuilding said quantization interval profile, as a function of said set of data and of the encoding technique designated by said indicator.

* * * * *